US009573146B2

(12) United States Patent
Prociw et al.

(10) Patent No.: US 9,573,146 B2
(45) Date of Patent: Feb. 21, 2017

(54) DOUBLE SWIRL CHAMBER SWIRLERS

(71) Applicants: Delavan Inc, West Des Moines, IA (US); Delavan Limited, West Midlands (GB)

(72) Inventors: Lev A. Prociw, Johnston, IA (US); Frank Whittaker, Cheshire (GB); Neil Smith, Lancashire (GB)

(73) Assignees: Delavan Inc, West Des Moines, IA (US); Delavan Limited, West Midlands (GB)

( * ) Notice: Subject to any disclaimer, the term of this patent is extended or adjusted under 35 U.S.C. 154(b) by 183 days.

(21) Appl. No.: 14/163,150

(22) Filed: Jan. 24, 2014

(65) Prior Publication Data

US 2015/0048182 A1 Feb. 19, 2015

Related U.S. Application Data

(60) Provisional application No. 61/866,301, filed on Aug. 15, 2013.

(51) Int. Cl.
*B05B 1/34* (2006.01)
*F23D 11/38* (2006.01)

(52) U.S. Cl.
CPC ..... *B05B 1/3426* (2013.01); *B05B 1/3431* (2013.01); *B05B 1/3447* (2013.01); *B05B 1/3468* (2013.01); *F23D 11/383* (2013.01)

(58) Field of Classification Search
CPC ..... B05B 1/3436; B05B 1/34; B05B 1/3447; B05B 1/3452; B05B 1/3484
USPC ..... 239/466, 463, 468, 492, 486, 491, 461, 239/600
See application file for complete search history.

(56) References Cited

U.S. PATENT DOCUMENTS

| | | | | |
|---|---|---|---|---|
| 3,532,271 | A * | 10/1970 | Polnauer | B05B 1/3436 239/1 |
| 3,680,793 | A | 8/1972 | Tate et al. | |
| 3,771,728 | A | 11/1973 | Polnauer | |
| 3,945,574 | A * | 3/1976 | Polnauer | B05B 7/10 239/404 |
| 6,695,229 | B1 | 2/2004 | Heinbuch et al. | |
| 7,611,079 | B2 | 11/2009 | Whittaker et al. | |
| 2009/0194611 | A1* | 8/2009 | Whittaker | B05B 1/3436 239/490 |

FOREIGN PATENT DOCUMENTS

| | | | |
|---|---|---|---|
| DE | 19815775 | A1 | 10/1999 |
| GB | 760972 | A | 11/1956 |
| WO | WO-03068408 | A1 | 8/2003 |

OTHER PUBLICATIONS

Extended European Search Report dated Jan. 8, 2015 for Application No. 14/179,167.3-1760.

* cited by examiner

*Primary Examiner* — Arthur O Hall
*Assistant Examiner* — Tuongminh Pham
(74) *Attorney, Agent, or Firm* — Locke Lord LLP; Scott D. Wofsy; Christopher J. Cillié

(57) ABSTRACT

A swirler for swirling fluid in a nozzle has a swirler body. The swirler body defines an inlet end, an outlet end opposed to the inlet end, and a circumferential periphery. The circumferential periphery extends axially from the inlet end to the outlet end. The outlet end defines a first swirl chamber. The inlet end defines a second swirl chamber.

17 Claims, 3 Drawing Sheets

Fig. 3C
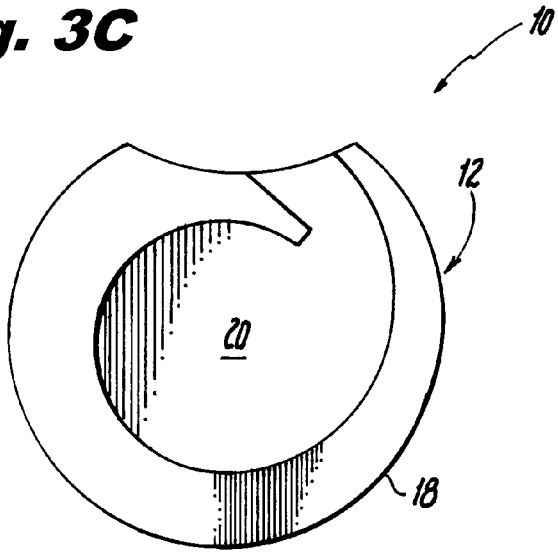
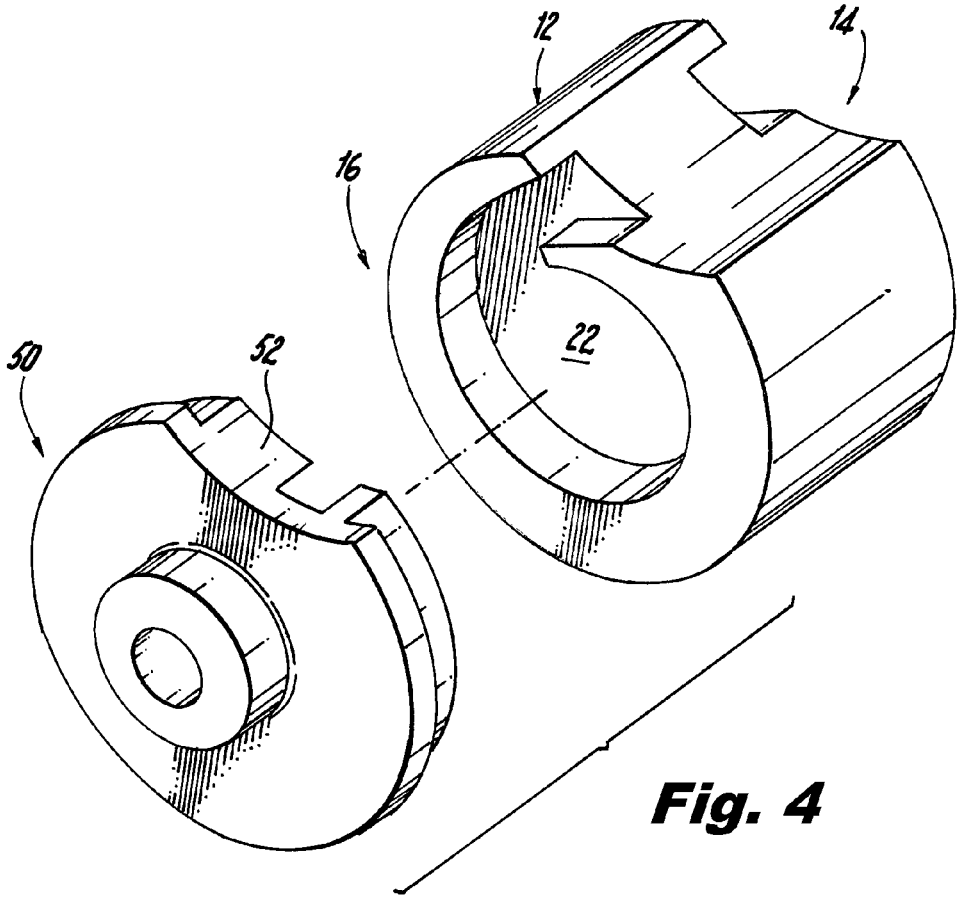
Fig. 4

DOUBLE SWIRL CHAMBER SWIRLERS

CROSS-REFERENCE TO RELATED APPLICATIONS

This application claims the benefit of priority to U.S. Provisional Patent Application No. No. 61/866,301 filed Aug. 15, 2013 and is incorporated by reference herein in its entirety.

BACKGROUND OF THE INVENTION

1. Field of the Invention

The present disclosure relates to nozzles, and more particularly to swirler elements for nozzles for swirling fluid flowing through the nozzle, for example as in spray dry nozzles.

2. Description of Related Art

Fluid nozzles or atomizers having spiral swirl chambers have been employed for various applications including spray drying, aeration, cooling, and fuel injection. Such nozzles operate by forcing a fluid composed of a liquid and a suspension, dispersion, emulsion, or slip of abrasive material through a swirl chamber. The swirl chamber changes the direction of the liquid and imparts a rotation or swirl to the fluid flow. This causes the fluid to exit the nozzle in a cone of small droplets that are well dispersed into the environment outside the nozzle.

In applications such as spray drying, the fluid feed pressure supplies the energy for fluid atomizing. The fluid feed pressure can exceed 5,000 psi, and in certain applications, exceeds 10,000 psi. Because of the nature of the fluid and the high pressure of the pumping process, swirl units can require frequent replacement due to erosion of the surfaces defining the swirl chamber. Replacement requires taking the process equipment out of service, replacing the eroded swirler unit, and returning the process equipment to service. Such replacement events reduce the availability of the process equipment during the replacement process.

Conventional swirler units have generally been considered satisfactory for their intended purpose. However, there is a need for swirler units that allow for increased usable life. There is also a continuing need for swirler units that are easy to make and use. The present disclosure provides solutions to these needs.

SUMMARY OF THE INVENTION

A swirler for swirling fluid in a nozzle includes a swirler body. The swirler body defines an inlet end, an outlet end opposed to the inlet end, and a circumferential periphery. The circumferential periphery extends axially from the inlet end to the outlet end. The outlet end defines a first swirl chamber and the inlet end defines a second swirl chamber.

In certain embodiments, the swirler has a feed channel defined in the circumferential periphery from the inlet end to the outlet end of the swirler body. The feed channel can define a channel surface with an arcuate cross-section, so if placed in a circular interior bore the channel surface and interior bore define a flow passage with a biconvex lens shaped cross-section. The first swirl chamber can be in fluid communication with the feed channel for supplying fluid from the feed channel to be swirled in the first swirl chamber. The second swirl chamber can also be in fluid communication with the feed channel for supplying fluid from the feed channel to be swirled in the second swirl chamber.

In accordance with certain embodiments, a tangential swirl slot is defined in the outlet end of the swirler body, placing the feed channel in fluid communication with the first swirl chamber and for imparting swirl on fluid fed into the first swirl chamber. A second tangential swirl slot can be defined in the inlet end of the swirler body to place the feed channel in fluid communication with the second swirl chamber and for imparting swirl on fluid fed into the second swirl chamber. Each tangential swirl slot can include a metering orifice for metering flow into the first swirl chamber. The tangential swirl slots can be angled to provide counter-clockwise swirl in one of the first and second swirl chambers and clockwise swirl in the other of the first and second swirl chambers.

A spray nozzle includes a nozzle body with an interior bore. The interior bore extends from an inlet to an opposed outlet and has an interior locating surface defined within the interior bore. A swirler as described above is disposed within the interior bore and is engaged with the locating surface such that the first swirl chamber is positioned proximate the outlet of the nozzle body. An orifice disc is disposed within the interior bore between the swirler and the outlet of the nozzle body. The orifice disc defines an orifice therethrough in fluid communication with the swirl chamber and the outlet of the nozzle body for issuing a swirling spray from the nozzle body outlet.

In certain embodiments, a cap is disposed within the interior bore and engaged with the inlet end of the swirler body for closing off the second swirl chamber. The cap can include a swirl chamber insert for mating engagement with the second swirl chamber to close off the second swirl chamber. The cap can also define a lunate cutout corresponding to the flow passage cross-section. A locking member can be engaged within the interior bore for locking the swirl element and orifice disc within the interior bore. The locking member can define a flow passage from the inlet of the nozzle body to the channel of the swirl element.

A kit includes a spray nozzle. The spray nozzle includes a nozzle body, a swirler, an orifice disc, and a cap. The nozzle body defines an interior bore extending from an inlet to an opposed outlet with an interior locating surface defined in the interior bore. The swirler is as described above and configured to be disposed within the interior bore and engaged with the locating surface with the first swirl chamber positioned proximate the outlet of the nozzle body. The orifice disc is configured to be disposed within the interior bore between the swirler and the outlet of the nozzle body, and defines an orifice therethrough for fluid communication with the swirl chamber and the outlet of the nozzle body for issuing a swirling spray from the nozzle body outlet. The cap is configured to be disposed within the interior bore engaged with the inlet end of the swirler body for closing off the second swirl chamber, and includes a swirl chamber insert for mating engagement with the second swirl chamber to close off the second swirl chamber. The kit also can include a second cap configured to be disposed within the interior bore and engaged with the outlet end of the swirler body for closing off the first swirl chamber when the second swirl chamber is in use. The second cap can also include a swirl chamber insert for mating engagement with the first swirl chamber to close off the first swirl chamber.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 3C is an inlet end view of the swirler of FIG. 1, schematically indicating the cross-sectional shape of the flow path through the feed channel; and FIG. 4 is an exploded perspective view of a cap with a swirler of FIG. 1, showing the swirl chamber insert of the cap.

DETAILED DESCRIPTION OF THE PREFERRED EMBODIMENTS

Figure 1:
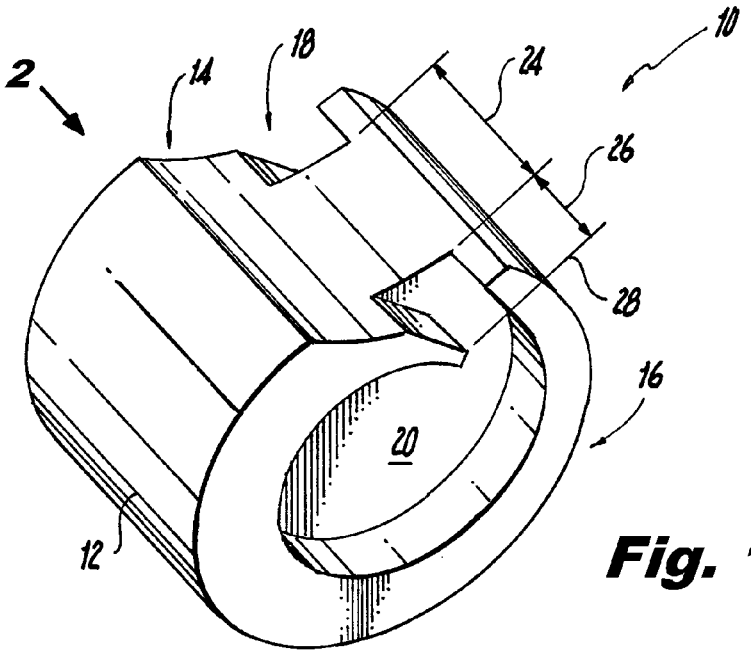
FIG. 1 is a perspective view of an exemplary embodiment of a swirler constructed in accordance with the present disclosure, showing an inlet end and first swirl chamber of the swirler.
Figure 2:
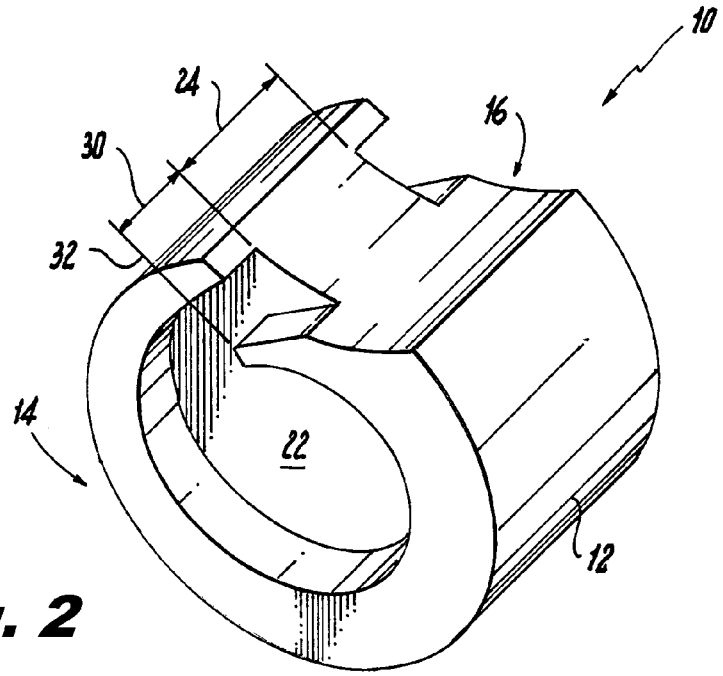
FIG. 2 is a perspective view of the swirler of FIG. 1, showing an outlet end and second swirl chamber of the swirler.

Reference will now be made to the drawings wherein like reference numerals identify similar structural features or aspects of the subject disclosure. For purposes of explanation and illustration, and not limitation, a partial view of an exemplary embodiment of a swirler in accordance with the disclosure is shown in FIG. 1 and is designated generally by reference character 10. Other embodiments of the swirler in accordance with the disclosure, or aspects thereof, are provided in FIGS. 2-4, as will be described. The systems and methods described herein can be used for fluid swirling equipment, such as in spray dry facilities for example.

A swirler 10 for swirling fluid in a nozzle 100 (shown in FIG. 3B) includes a swirler body 12. Swirler body 12 defines an inlet end 14, an outlet end 16 opposed to inlet end 14, and a circumferential periphery 18. Circumferential periphery 18 extends axially from inlet end 14 to outlet end 16. Outlet end 16 defines a first swirl chamber 20 and inlet end 14 defines a second swirl chamber 22 (shown in FIG. 2).

Swirler 10 has a feed channel 24 defined in circumferential periphery 18. Feed channel 24 extends from inlet end 14 to outlet end 16 of swirler body 10. First swirl chamber 20 is in fluid communication with feed channel 24 for supplying fluid from feed channel 24 to be swirled in first swirl chamber 20 through tangential swirl slot 26 for imparting swirl on fluid fed into first swirl chamber 20. Tangential swirl slot 26 includes a metering orifice 28 for metering flow into first swirl chamber 20.

Swirler 10 includes first tangential swirl slot 26 defined in outlet end 16 of swirler body 12 placing feed channel 24 in fluid communication with first swirl chamber 20. First tangential swirl slot 26 also imparts swirl on fluid fed into first swirl chamber 20. Swirler 10 also includes second tangential swirl slot 30 defined in inlet end 14 of swirler body 12 placing feed channel 24 in fluid communication with second swirl chamber 22 and for imparting swirl on fluid fed into second swirl chamber 22 by way of a second tangential swirl slot 30 defined in inlet end 14 of swirler body 12. Second tangential swirl slot 30 also imparts swirl on fluid fed into second swirl chamber 22. Tangential swirl slot 26 includes a metering orifice 32 for metering flow into first swirl chamber 20. Tangential swirl slot 26 is angled to provide clockwise swirl in 20 and tangential swirl slot 30 is angled to provide counter clockwise swirl in second swirl chamber 22.

Figure 3A:
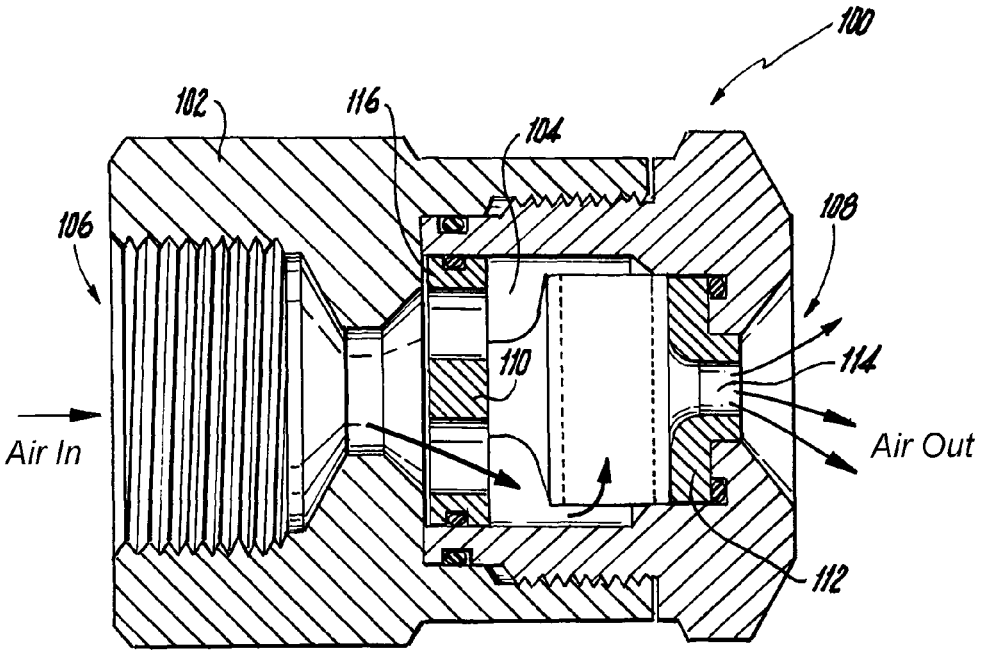
Fig. 3A (Prior Art)
FIG. 3A is a schematic cross-sectional side view of a prior art nozzle.
Figure 3B:
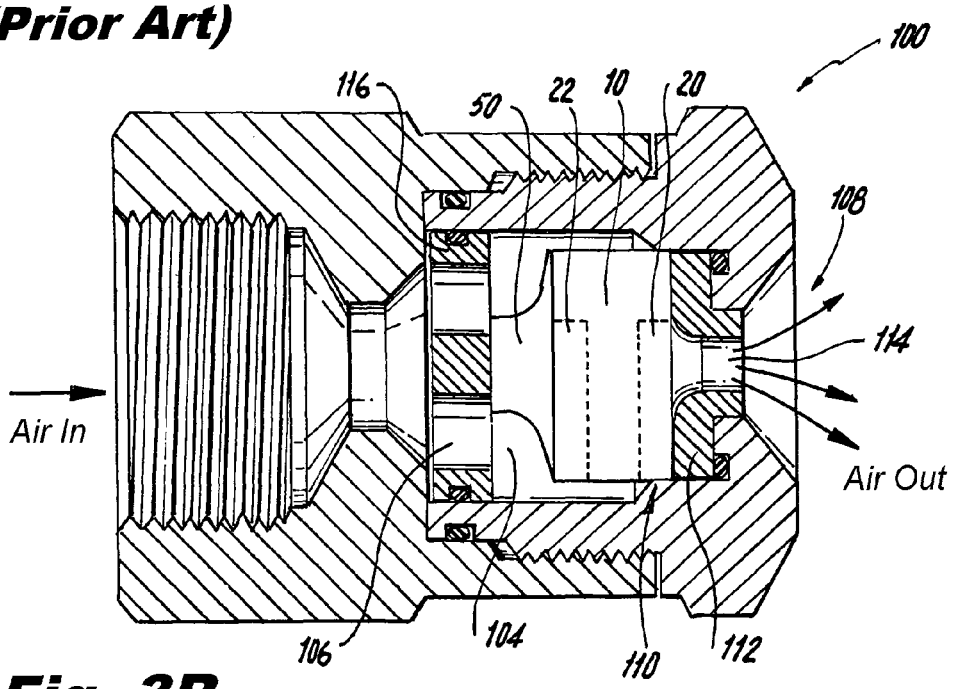
FIG. 3B is a schematic cross-sectional view of a nozzle including the swirler of FIG. 1, showing one arrangement of the swirler in the nozzle.

With reference now to FIG. 3B, spray nozzle 100 includes a nozzle body 102 with an interior bore 104. Spray nozzle 100 is similar in construction to that described in U.S. Pat. No. 7,611,079, the contents of which are incorporated herein by reference in the their entirety. Interior bore 104 extends from an inlet 106 to an opposed outlet 108 and has an interior locating surface 110 defined within interior bore 104. Swirler 10, as described above, is disposed within interior bore 104 and is engaged with locating surface 110 such that first swirl chamber 20 is positioned proximate outlet 108 of nozzle body 102. An orifice disc 112 is disposed within the interior bore 104 between swirler 10 and outlet 108 of nozzle body 102. Orifice disc 112 defines an orifice 114 therethrough in fluid communication with swirl chamber 20 and outlet 108 of nozzle body 102 for issuing a swirling spray from nozzle body outlet 108.

A locking member 116 engages within interior bore 104 for locking swirler 10 and orifice disc 112 within interior bore 104. Locking member 116 defines a flow passage from inlet 106 of nozzle body 102 to feed channel 24 of swirl element 10.

Referring now to FIG. 3C, feed channel 24 is defined in circumferential periphery 18 along a segment extending between inlet end 14 to outlet end 16 of swirler body 12. Feed channel 24 defines a channel surface 34 with an arcuate cross-section. As indicated schematically in FIG. 3C, a portion of circular shaped interior bore 104 and a surface 34 of swirler body 12 forming feed channel 24, defining a flow passage with a biconvex lens shaped cross-section.

With reference again to FIG. 3B, a cap 50 shown in FIG. 4, is disposed within interior bore 104 and engaged with inlet end 16 of swirler body 12 for closing off second swirl chamber 22. Cap 50 includes a swirl chamber insert 52 for mating engagement with second swirl chamber 22 to close off second swirl chamber 22 and defines a lunate cutout corresponding to the feed channel cross-section. As will be appreciated by those skilled in the art, a similar cap can be configured for engagement with first swirl chamber 20. A spray nozzle kit includes one or both caps.

The systems and methods disclosed herein can be used for existing nozzle installations, simplifying the upgrade process by reusing an existing nozzle body and orifice disk. By including swirl chambers on each end of the swirler, life of a single swirler can be doubled. Moreover, since a single swirler having two swirl chambers can be manufactured more cheaply than a two swirlers each with single swirl chambers, cost of the swirler is lower on a per swirler chamber basis. Numbers of swirlers warehoused as spares can also be correspondingly reduced.

The methods and systems of the present disclosure, as described above and shown in the drawings, provide for swirlers with superior properties including increased usable life compared to traditional configurations. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A swirler for swirling fluid in a nozzle comprising:

a swirler body defining:

an inlet end;

an outlet end opposed to the inlet end; and a circumferential periphery extending axially from the inlet end to the outlet end, wherein the outlet end defines a first swirl chamber with an axial depth, wherein the inlet end defines a second swirl chamber with an axial depth, wherein the axial depth of the first swirl chamber is equivalent to the axial depth of the second swirl chamber; and a first configuration wherein the second swirl chamber is adjacent the outlet end, and further comprising a first cap having a first chamber insert to mate with the first swirl chamber, the first cap closing off the first swirl chamber from a flow of fluid traversing the swirler body; and a second configuration wherein the first swirl chamber is adjacent the outlet end, and further comprising a second cap having a second chamber insert to mate with the second swirl chamber, the second cap closing off the second swirl chamber from a flow of fluid traversing the swirler body.

2. A swirler as recited in claim 1, further comprising a feed channel defined in the circumferential periphery from the inlet end to the outlet end of the swirler body.

3. A swirler as recited in claim 2, wherein the first swirl chamber is in fluid communication with the feed channel for supplying fluid from the feed channel to be swirled in the first swirl chamber.

4. A swirler as recited in claim 3, further comprising a tangential swirl slot defined in the outlet end of the swirler body placing the feed channel in fluid communication with the first swirl chamber and for imparting swirl on fluid fed into the first swirl chamber.

5. A swirler as recited in claim 4, wherein the tangential swirl slot includes a metering orifice for metering flow into the first swirl chamber.

6. A swirler as recited in claim 2, wherein the first and second swirl chambers are both in fluid communication with the feed channel for supplying fluid from the feed channel to be swirled in at least one of the swirl chambers.

7. A swirler as recited in claim 6, further comprising:

a first tangential swirl slot defined in the outlet end of the swirler body placing the feed channel in fluid communication with the first swirl chamber and for imparting swirl on fluid fed into the first swirl chamber; and a second tangential swirl slot defined in the inlet end of the swirler body placing the feed channel in fluid communication with the second swirl chamber and for imparting swirl on fluid fed into the second swirl chamber.

8. A swirler as recited in claim 7, wherein each tangential swirl slot includes a metering orifice for metering flow therethrough.

9. A swirler as recited in claim 7, wherein the first swirl chamber is configured to swirl fluid in a clockwise direction about the swirler axis, wherein the second swirl chamber is configured to swirl fluid in a counterclockwise direction about the swirler axis, and wherein the tangential swirl slots are angled to provide counter-clockwise swirl in one of the first and second swirl chambers and clockwise swirl in the other of the first and second swirl chambers.

10. A spray nozzle, comprising:

a nozzle body defining an interior bore extending from an inlet to an opposed outlet, with an interior locating surface defined in the interior bore;

a swirler as recited in claim 1 disposed within the interior bore engaged with the locating surface with the first swirl chamber positioned proximate the outlet of the nozzle body; and an orifice disc disposed within the interior bore between the swirler and the outlet of the nozzle body, wherein the orifice disc defines an orifice therethrough in fluid communication with the swirl chamber and the outlet of the nozzle body for issuing a swirling spray from the nozzle body outlet.

11. A spray nozzle as recited in claim 10, further comprising a locking member engaged within the interior bore for locking the swirl element and orifice disc within the interior bore, the locking member defining a flow passage from the inlet of the nozzle body to the channel of the swirl element.

12. A spray nozzle as recited in claim 10, further comprising a feed channel defined in the circumferential periphery from the inlet end to the outlet end of the swirler body.

13. A spray nozzle as recited in claim 12, wherein the feed channel defines a channel surface with an arcuate cross-section, wherein the interior bore is circular, and wherein the channel surface and the interior bore define a flow passage with a biconvex lens shaped cross-section.

14. A spray nozzle as recited in claim 12, wherein the first swirl chamber is in fluid communication with the feed channel for supplying fluid from the feed channel to be swirled in the first swirl chamber.

15. A spray nozzle as recited in claim 12, wherein the first and second swirl chambers are both in fluid communication with the feed channel for supplying fluid from the feed channel to be swirled in at least one of the swirl chambers.

16. A spray nozzle as recited in claim 13, wherein each of the first and second caps defines a lunate cutout corresponding to the flow passage cross-section.

17. A kit comprising:

a spray nozzle including:

a nozzle body defining an interior bore extending from an inlet to an opposed outlet, with an interior locating surface defined in the interior bore;

a swirler as recited in claim 1 configured to be disposed within the interior bore engaged with the locating surface with the first swirl chamber positioned proximate the outlet of the nozzle body;

an orifice disc configured to be disposed within the interior bore between the swirler and the outlet of the nozzle body, wherein the orifice disc defines an orifice therethrough for fluid communication with the swirl chamber and the outlet of the nozzle body for issuing a swirling spray from the nozzle body outlet, wherein the first cap is configured to be disposed within the interior bore and engaged with the inlet end of the swirler body for closing off the first swirl chamber, wherein the first cap defines a lunate cutout, wherein the second cap is configured to be disposed within the interior bore and engaged with the inlet end of the swirler body for closing off the second swirl chamber, wherein the second cap defines a lunate cutout.

* * * * *